US005745945A

United States Patent [19]

Manfredi et al.

[11] Patent Number: 5,745,945

[45] Date of Patent: May 5, 1998

[54] BRUSH CONDITIONER FOR A SEMICONDUCTOR CLEANING BRUSH

[75] Inventors: Paul A. Manfredi, Waterbury; Raymond G. Morris, Essex Junction, both of Vt.

[73] Assignee: International Business Machines Corporation, Armonk, N.Y.

[21] Appl. No.: 674,240

[22] Filed: Jun. 28, 1996

[51] Int. Cl.[6] ..... B08B 11/00

[52] U.S. Cl. ..... 15/77; 15/21.1; 15/88.3; 15/256.52

[58] Field of Search ..... 15/21.1, 77, 88.3, 15/102, 103.5, 256.51, 256.52; 118/203, 261, 262

[56] References Cited

U.S. PATENT DOCUMENTS

| | | | |
|---|---|---|---|
| 1,529,691 | 3/1925 | Davis | 15/77 |
| 2,541,301 | 2/1951 | Sissler | 15/256.5 |
| 3,120,805 | 2/1964 | Simon | 15/256.52 |
| 3,278,972 | 10/1966 | Hudson . | |
| 3,656,200 | 4/1972 | Riley, Jr. | 15/256.52 |
| 3,766,593 | 10/1973 | Becker et al. . | |
| 4,172,303 | 10/1979 | Wooding | 15/256.52 |
| 4,475,807 | 10/1984 | Toyoda | 15/256.52 |
| 4,566,911 | 1/1986 | Tomita et al. . | |
| 5,103,525 | 4/1992 | Nakayama . | |
| 5,384,931 | 1/1995 | Hanson . | |

FOREIGN PATENT DOCUMENTS

| | | | |
|---|---|---|---|
| 87053 | 1/1922 | Austria | 15/77 |
| 191039 | 3/1967 | U.S.S.R. | 15/256.52 |

*Primary Examiner*—Randall Chin

*Attorney, Agent, or Firm*—Schmeiser, Olsen & Watts; Howard J. Walter, Jr.

[57] ABSTRACT

Disclosed is a brush conditioning apparatus for attachment to a wafer cleaning tool having a cylindrical brush. The brush conditioning apparatus includes a freely rotatable, cylindrically shaped brush conditioner that can be adjustably mounted onto an existing wafer cleaning tool. The apparatus also includes a fluid injection system that has an intake port on at least one end of the cylindrical brush conditioner and includes fluid dispensing outlets along the radial surface of the brush conditioner. Because the brush conditioner is freely mounted onto the brush cleaning tool and in contact with the cleaning brush, a counter rotation of the brush conditioner will occur as the cleaning brush is rotated.

12 Claims, 4 Drawing Sheets

BRUSH CONDITIONER FOR A SEMICONDUCTOR CLEANING BRUSH

BACKGROUND OF THE INVENTION

1. Technical Field

This invention generally relates to brush cleaning tools for silicon wafers, and more specifically relates to a brush conditioner for conditioning a cylindrical brush.

2. Background Art

Many of today's industrial operations require the efficient and accurate ability to polish and clean highly finished surfaces. Semiconductor materials, such as silicon wafers, require the removal of particles and other surface contaminants during the manufacturing process. Other surfaces, such as optical glass or magnetic storage devices may also require a similar means for contaminant removal. Different types of brush cleaning tools, such as one manufactured by ON TRACK™, have been designed for this process. These tools utilize a cylindrical rotating brush saturated with water or fluid in contact with the wafer surface to clean planarization slurry, etchant and pad residuals from the wafer surface.

In order to ensure high performance, it is critical that the cylindrical brush remain clean. Currently, in order to maintain the necessary precision, brushes on brush cleaning tools must be regularly replaced due to the residual slurry, etchant and chemical mechanical planarization (CMP) pad particles which become entrapped within the brush during the post CMP brush cleaning operation. The need to continually replace the brushes adds undesired time and cost to the manufacturing of silicon wafers. Until now, no solution has existed to extend the life of a brush on a brush cleaning tool. Thus, a need existed to provide a means for extending the usefulness of the cylindrical brushes found on many of today's brush cleaning tools.

DISCLOSURE OF INVENTION

The present invention provides a brush conditioning apparatus for attachment to a wafer cleaning tool that has a cylindrical brush. The brush conditioning apparatus is a freely rotatable, cylindrically-shaped brush conditioner that can be adjustably mounted onto an existing wafer cleaning tool. By properly adjusting the brush conditioner to the appropriate position, radial contact with the existing cylindrical cleaning brush can be maintained such that a continuous conditioning of the cleaning brush occurs. In addition, a fluid injection system is included that has an intake port located at one end of the brush conditioner and a fluid dispensing outlet positioned somewhere along the radial surface of the brush conditioner. Within the cylindrically shaped brush conditioner, there exists an interior fluid cavity that receives fluid from the intake port and distributes it to the dispensing outlet. The brush conditioner may include any type of surface that will provide for the most effective conditioning of the brush, and may include nubs or any other type of surface.

In accordance with the above, it is an advantage of the present invention to provide a brush conditioner for a cylindrical brush that can easily be attached to existing brush cleaning tools.

It is a further advantage of the present invention to provide a brush conditioning apparatus that mounts easily onto a cylindrically rotating brush cleaning tool.

It is a further advantage of the present invention to provide a compression adjustment means such that optimal positioning of the brush conditioner can be maintained to create a squeegee effect on the brush.

It is a further advantage of the present invention to a provide for injection of a rinsing fluid onto the brush to flush the brush clean as it is squeegeed.

It is a further advantage of the present invention to provide a system wherein the brush conditioner is rotated as a result of existing brush rotation.

It is a further advantage of the present invention to provide a brush conditioner that has free wheeling counter rotation.

It is a further advantage of the present invention to reduce foreign material levels to maintain tool qualification parameters.

It is a further advantage of the present invention to extend the useful brush life expectancy and increase cleanability of the brush tool.

It is a further advantage of the present invention to reduce the cost of ownership and enhance yield due to lower contamination levels and lower defect density.

The foregoing and other objects, features and advantages of the invention will be apparent from the following more particular description of the Preferred Embodiments of the Invention, as illustrated in the accompanying drawings.

BRIEF DESCRIPTION OF DRAWINGS

The preferred exemplary embodiment of the present invention will hereinafter be described in conjunction with the appended drawings, where like designations denote like elements and.

BEST MODE FOR CARRYING OUT THE INVENTION

Figure 1:
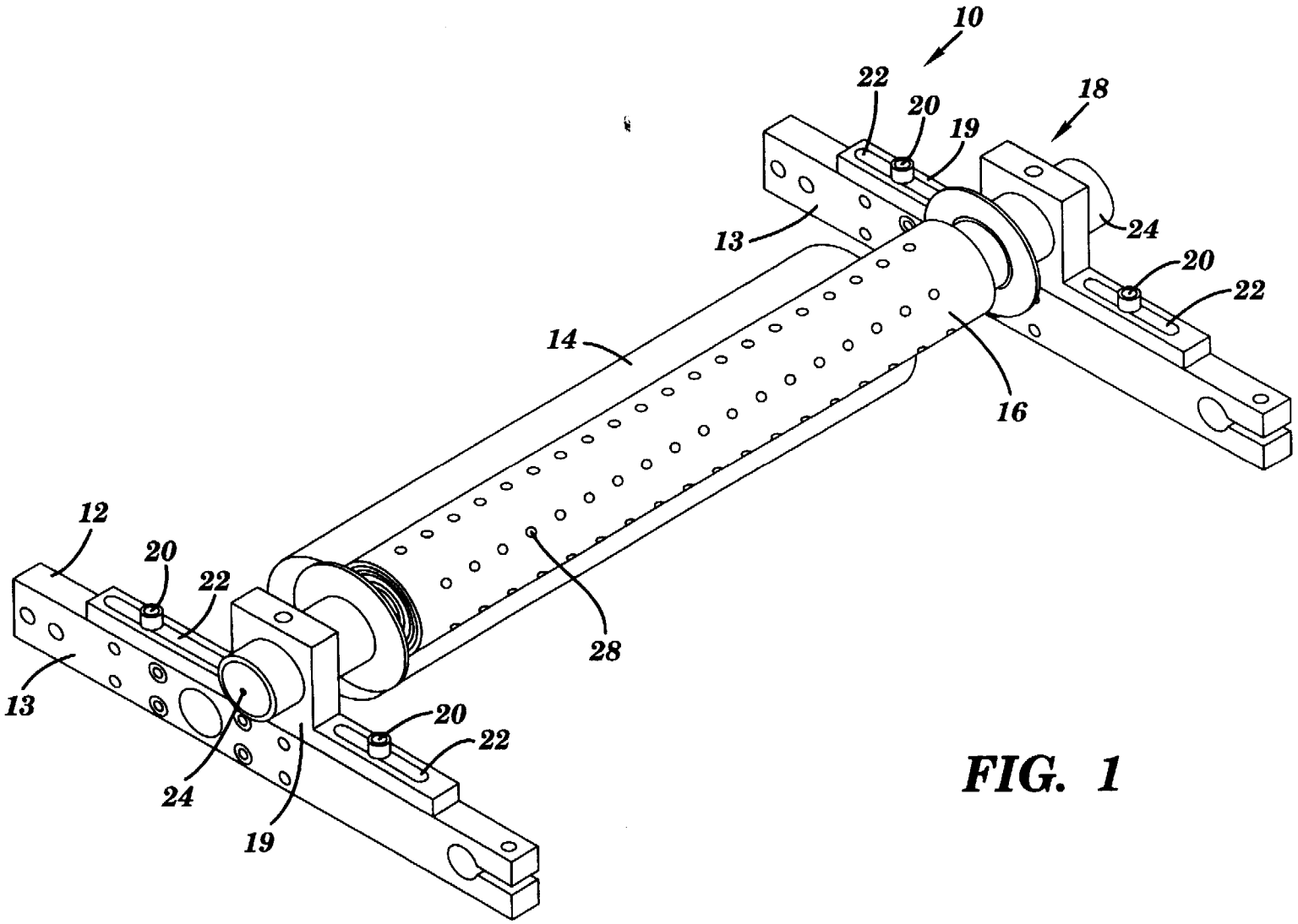
FIG. 1 discloses an isometric view of a brush conditioning apparatus affixed to an existing brush cleaning tool.

Referring now to the figures, FIG. 1 depicts a preferred embodiment of a cleaning system 10 that includes a brush conditioning apparatus 18 attached to an existing brush cleaning tool 12. Brush cleaning tool 12 includes a pair of side rails 13 with a cylindrical "wafer" brush 14 S mounted therebetween. As shown, brush conditioning apparatus 18 is mounted onto the existing brush cleaning tool 12. Brush cleaning apparatus 18 includes a pair of mounting devices 19 mounted on side rails 13. Mounting devices 19 are secured to side rails 13 via screws 20. In addition, mounting devices 19 are slidably adjustable along the top of side rails 13 such that the position of the brush conditioner can be adjusted forward and back. Brush conditioning apparatus 18 includes a cylindrically-shaped brush conditioner 16 having a circumferential surface mounted between mounting devices 19 such that the brush conditioner 16 radially contacts cylindrical brush 14. Because brush conditioner 16 is also cylindrical in shape, any rotation of cleaning brush 14 causes a counter rotation of brush conditioner 16. To further facilitate the efficacy of brush conditioner 16, nubs 28 may be placed along the radial surface of the brush conditioner.

In operation, cylindrical cleaning brush 14 will generally be driven by some type of motor and be used for the cleaning and polishing of silicon wafers. By mounting brush conditioner 16 in contact with brush cleaner 14, brush cleaner 14 is continuously being conditioned and cleaned. Furthermore, because brush conditioning apparatus includes channels 22 that allow for the adjustment of the brush conditioner 16, the user can select the amount of radial pressure imparted onto the cylindrical brush 14.

To further facilitate conditioning of cylindrical cleaning brush 14, a fluid is introduced into a fluid intake port 24 at either side of the brush conditioning apparatus. That fluid will then be delivered to the surface of the brush conditioner 16 for the purpose of further conditioning cleaning brush 14.

Figure 2:
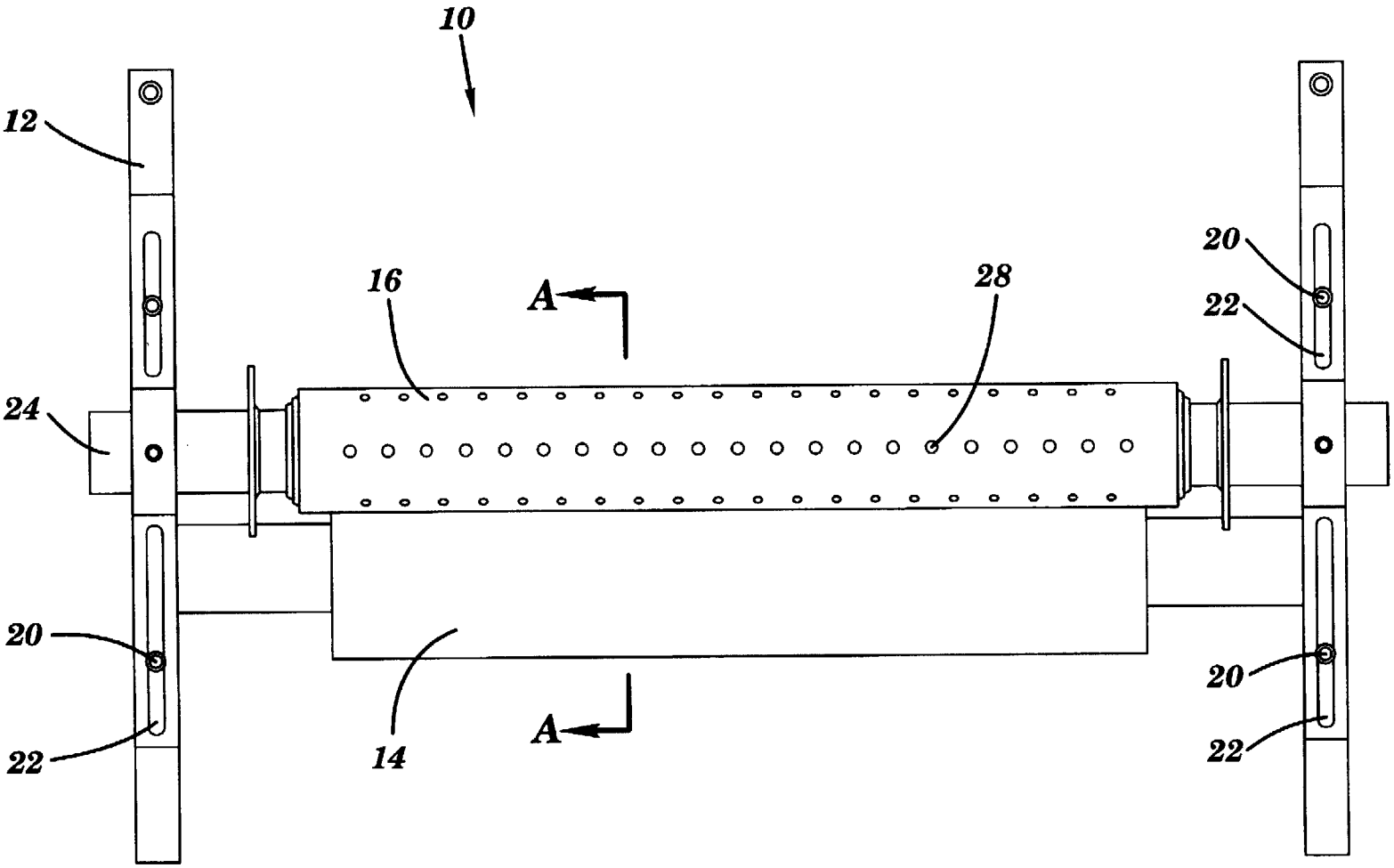
FIG. 2 depicts a top view of a brush conditioning apparatus in accordance with the present invention affixed to an existing brush cleaning tool.
Figure 3:
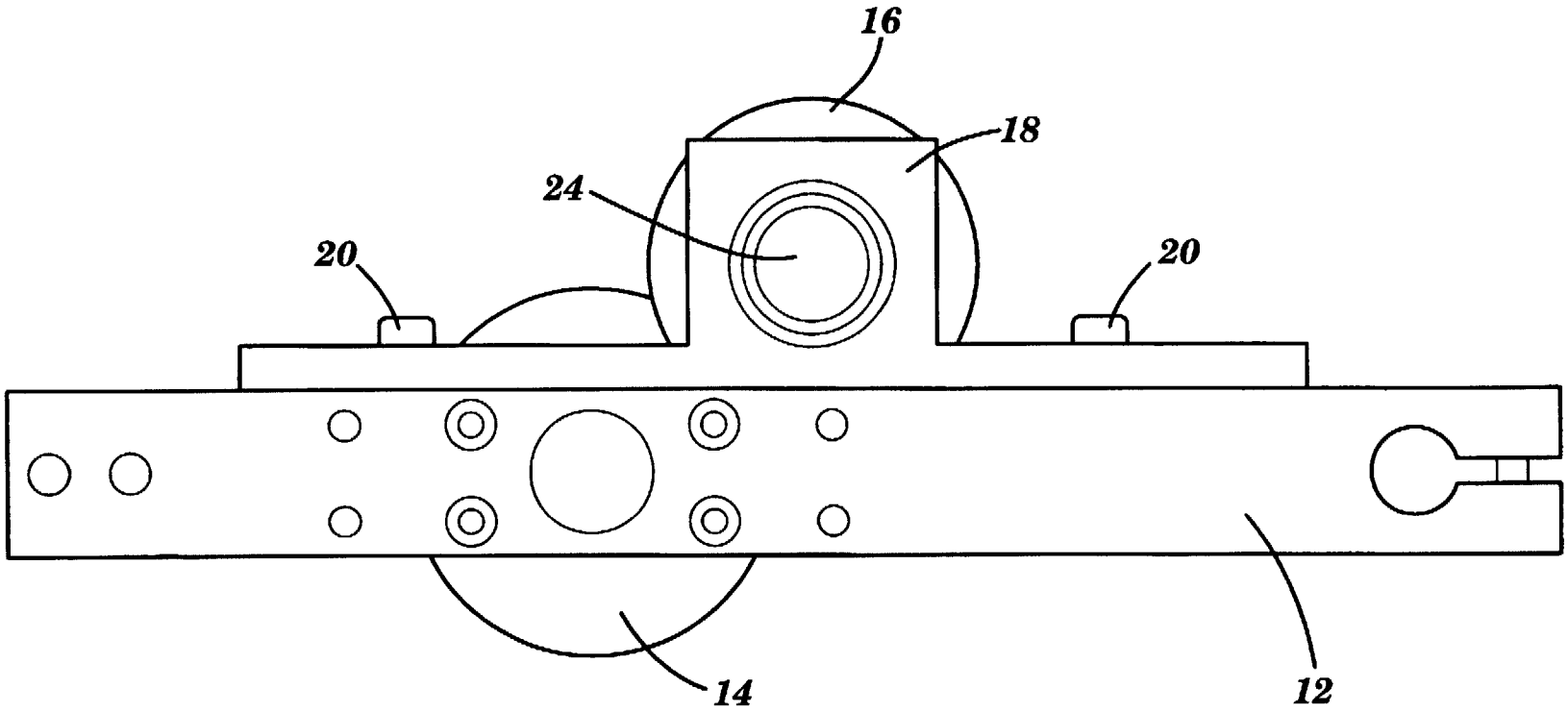
FIG. 3 depicts a side view of the brush conditioning apparatus in accordance with the present invention affixed to an existing brush cleaning tool.

FIG. 2 depicts a top view and FIG. 3 depicts a side view of a portion of an existing brush cleaning tool 12 with a brush conditioning apparatus 18 attached thereto. It can be seen in FIGS. 1–3 that mounting devices 19 of brush conditioning apparatus 18 are slidably adjustable along the top of the side rails 13 of brush cleaning tool 12. In particular, mounting devices 19 include channels 22 that allow screws 20 to secure brush conditioning apparatus 18 at varying positions along the top of the side rails 13. It is recognized, however, that any known means for adjustably attaching the brush conditioning apparatus 18 to the brush cleaning tool 12 may be utilized. Such means may include a clamping device, straps, interlocking parts or a quick release system. It is also recognized that for any variation on the brush cleaning tool 12, any suitable attachment system may be incorporated.

Figure 4:
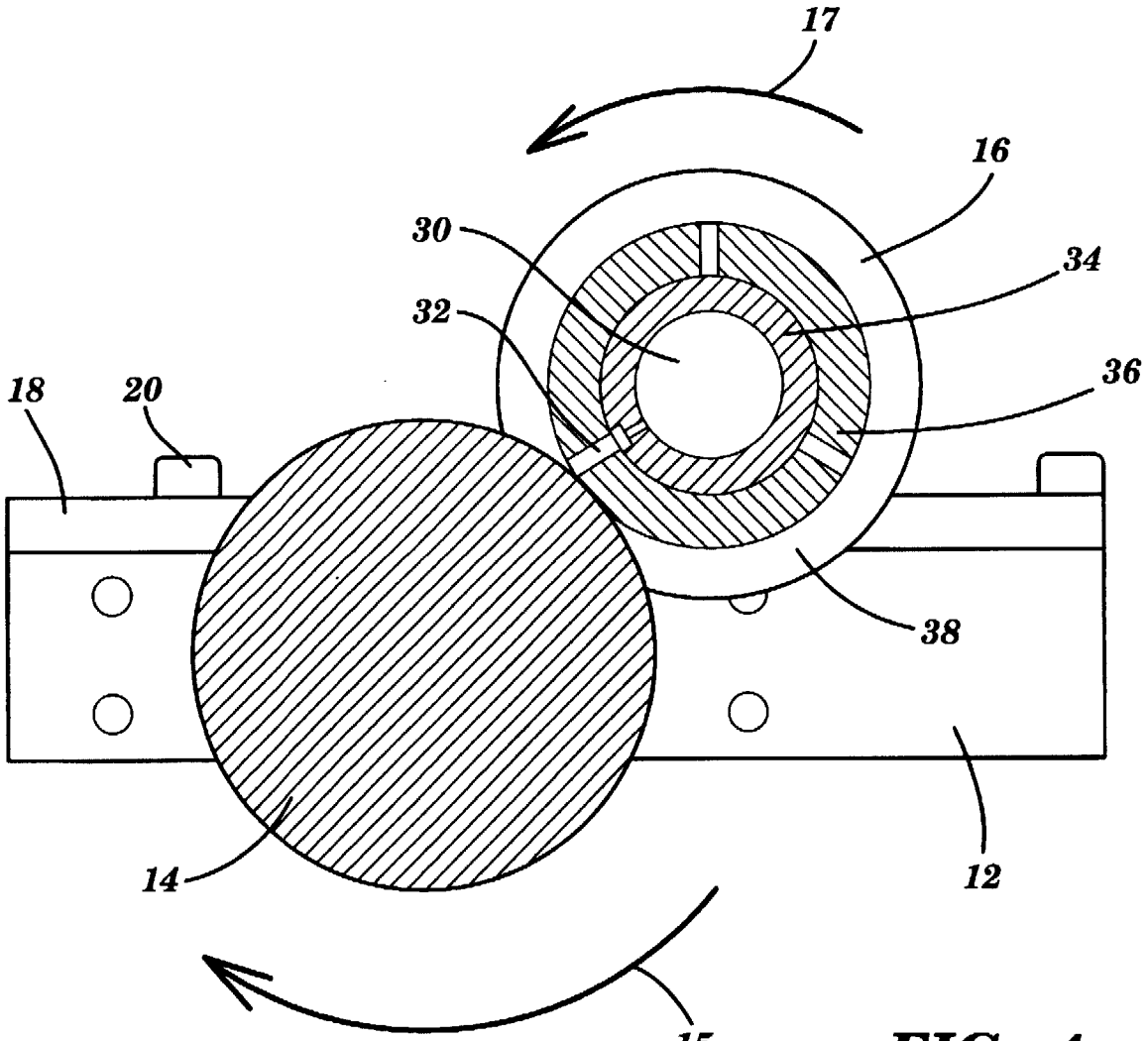
FIG. 4 depicts a cutaway side view of a brush conditioning apparatus in accordance with the present invention affixed to an existing brush cleaning tool.

Finally, FIG. 4 depicts a side cutaway view along cross section A—A. Here it is shown that cleaning brush 14 rotates in a direction of arrow 15 during the cleaning and polishing of a wafer. Because brush conditioner 16 is allowed to freely rotate, the contact of cleaning brush 14 will drive the counter rotation of brush conditioner 16 along in the direction of arrow 17. It can be seen from this view that brush conditioner 16 compresses as it contacts cleaning brush 14 to create a squeegee effect on cleaning brush 14. Furthermore, it can be seen that brush conditioner 16 includes a cavity 30 wherein fluid can collect and be furthered distributed via fluid dispensing shaft 32 to the surface of the brush conditioner. It is understood that any other suitable method of delivering a fluid to the surface of the brush/brush conditioner may be utilized. Also evident from FIG. 4 is the fact that brush conditioner 16 may have several different cross sectional materials 34, 36, 38 to better enhance the conditioning of cleaning brush 14. Generally speaking, the outer cross sectional area 38 will be a spongy material whereas the middle cross sectional area 36 and inner cross sectional area 34 will generally be made from more rigid materials. However, it should be recognized that this invention is not limited in scope to a specific material or combination of materials for use on a brush conditioner. Any suitable material[s] may be used to achieve the desired result.

While the invention has been particularly shown and described with referenced to a preferred exemplary embodiment thereof, it will be understood by those skilled in the art that various changes in form and details may be made therein without departing from the spirit and scope of the invention.

We claim:

1. A brush conditioning apparatus, said apparatus comprising:

a freely rotatable, cylindrically-shaped brush conditioner having a circumferential surface, said brush conditioner being adjustably mountable onto a wafer cleaning tool; and a fluid injection system having a first fluid intake port at a first end of said brush conditioner, a second fluid intake port at a second end of said brush conditioner, and at least one fluid dispensing outlet positioned on said circumferential surface of said brush conditioner.

2. The apparatus of claim 1 wherein said cylindrically-shaped brush conditioner has an interior fluid cavity coupled to said fluid intake port.

3. The apparatus of claim 2 wherein said cylindrically-shaped brush conditioner has at least one fluid dispensing shaft extending radially from said interior fluid cavity to said at least one fluid dispensing outlet.

4. The apparatus of claim 1 wherein said brush conditioner includes nubs protruding radially from the circumferential surface of said brush conditioner.

5. A wafer cleaning tool comprising:

a first and second rail;

a cylindrically-shaped wafer brush having a circumferential surface mounted between said first and second rail;

a freely rotatable, cylindrically-shaped brush conditioner having a circumferential surface adjustably mountable onto said first and second rail, said brush conditioner positioned in radial contact with said wafer brush; and a fluid injection system having a fluid intake port at a first end of said brush conditioner and a fluid dispensing outlet located on said circumferential surface of said brush conditioner.

6. The apparatus of claim 5 further comprising a second fluid intake port at a second end of said brush conditioner.

7. The apparatus of claim 5 wherein said cylindrically-shaped brush conditioner has an interior fluid cavity coupled to said fluid intake port.

8. The apparatus of claim 7 wherein said cylindrically-shaped brush conditioner has at least one fluid dispensing shaft extending radially from said interior fluid cavity to said at least one fluid dispensing outlet.

9. The apparatus of claim 5 wherein said brush conditioner includes nubs protruding radially from the circumferential surface of said brush conditioner.

10. A cleaning apparatus comprising:

a cylindrical brush;

a freely rotatable, cylindrically-shaped brush conditioner;

mounting means for adjustably mounting said cylindrically-shaped brush conditioner proximate said cylindrical brush in order to provide radial contact between the brush conditioner and the brush; and a fluid injection system having a fluid intake port at a first end of said brush conditioner and a plurality of fluid dispensing outlets located radially along said brush conditioner.

11. The apparatus of claim 10 further comprising a second fluid intake port at a second end of said brush conditioner.

12. The apparatus of claim 10 further comprising a motor for rotating said cylindrical brush.

* * * * *